US005577277A

United States Patent [19]

Sundberg et al.

[11] Patent Number: 5,577,277

[45] Date of Patent: Nov. 26, 1996

[54] COLLAPSABLE BED SIDE RAIL

[75] Inventors: Brian C. Sundberg, Franklin, Mass.; Brian H. Ordung, Woonsocket, R.I.; Michael S. Bernstein, Natick, Mass.

[73] Assignee: Safety 1st, Inc., Chestnut Hill, Mass.

[21] Appl. No.: 413,684

[22] Filed: Mar. 30, 1995

[51] Int. Cl.[6] ..... A47C 21/08

[52] U.S. Cl. ..... 5/426; 5/425

[58] Field of Search ..... 5/426, 425, 427–430, 5/662

[56] References Cited

U.S. PATENT DOCUMENTS

| | | | |
|---|---|---|---|
| 1,135,523 | 4/1915 | Henderson . | |
| 1,739,337 | 12/1929 | VonCanon et al. . | |
| 2,608,696 | 9/1952 | Le Roy | 5/100 |
| 2,763,014 | 9/1956 | Luger . | |
| 3,179,957 | 4/1965 | Norton . | |
| 3,402,409 | 9/1968 | Kain . | |
| 3,482,810 | 12/1969 | Bailey . | |
| 3,747,133 | 7/1973 | Hutt | 5/100 |
| 3,971,083 | 7/1976 | Peterson | 5/100 |
| 4,084,277 | 4/1978 | Conrad et al. | 5/100 |
| 4,103,376 | 8/1978 | Benoit et al. | 5/100 |
| 4,178,645 | 12/1979 | Cosme | 5/426 |
| 4,214,327 | 7/1980 | Smith | 5/426 |
| 4,431,154 | 2/1984 | Hamm | 5/503.1 |
| 4,483,028 | 11/1984 | Payne | 5/426 |
| 4,484,367 | 11/1984 | Jenkins | 5/425 |
| 4,672,703 | 6/1987 | Frazier | 5/503.1 |
| 4,724,559 | 2/1988 | Bly | 5/425 |
| 4,747,171 | 5/1988 | Einsele | 5/425 |
| 4,783,864 | 11/1988 | Turner | 5/425 |
| 4,833,743 | 5/1989 | Howell et al. | 5/426 |
| 5,038,430 | 8/1991 | Bly | 5/425 |
| 5,044,025 | 9/1991 | Honsinger et al. | 5/425 |
| 5,148,356 | 9/1992 | Freese et al. | 362/130 |
| 5,175,897 | 1/1993 | Marra, Jr. | 5/425 |
| 5,191,663 | 3/1993 | Holder et al. | 5/425 |
| 5,365,623 | 11/1994 | Springer | 5/658 |
| 5,437,067 | 8/1995 | Bernstein et al. | 5/426 |

FOREIGN PATENT DOCUMENTS 2200541 8/1988 United Kingdom .

*Primary Examiner*—Alexander Grosz
*Attorney, Agent, or Firm*—Wolf, Greenfield & Sacks, P.C.

[57] ABSTRACT

A collapsible children's bed rail which can conveniently be disassembled for storage and transport. The bed rail has a side panel made up of two detachable sections which snap together to form a continuous panel when in use and can be stored in face to face relationship when separated. A pair of supports attach to the bottom of the assembled side panel and extend perpendicular to it and fit underneath the mattress of the bed with which the bed rail is to be used and hold the side panel in operative position. The supports may be collapsed so that their components lie in face to face relationship, and they can be stored in cavities in the bottoms of the panel sections when detached from the side panel.

10 Claims, 6 Drawing Sheets

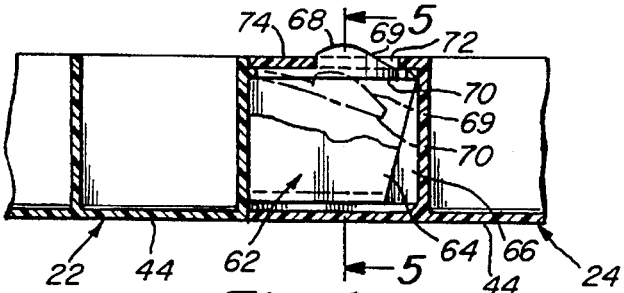
Fig. 4
Fig. 5
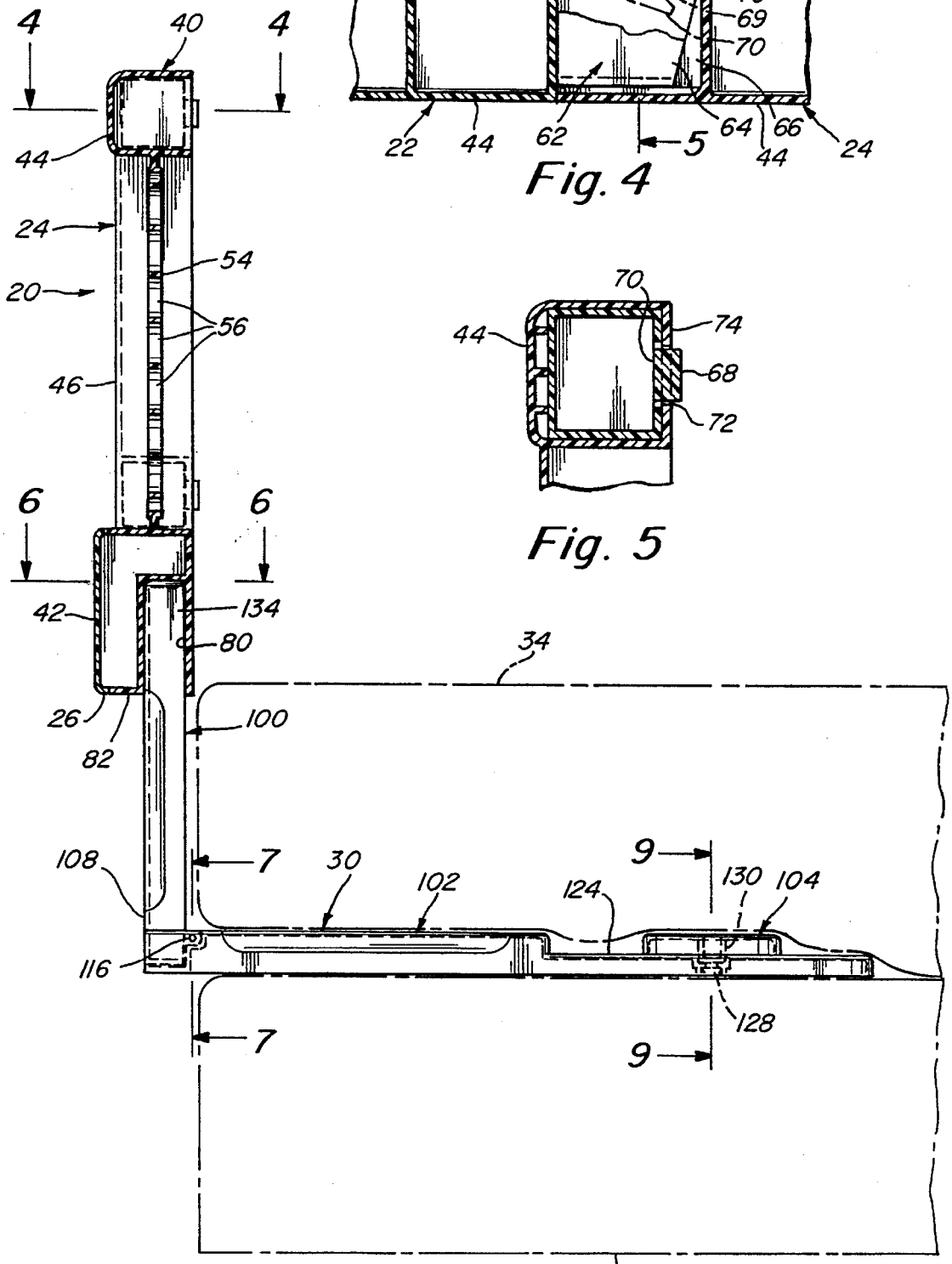
Fig. 3

COLLAPSABLE BED SIDE RAIL

FIELD OF THE INVENTION

This invention relates to side rails for beds and more particularly comprises a collapsible bed rail to be used by children and which can be conveniently stored and transported.

BACKGROUND

Bed rails are regularly used for young children when making the transition from a crib to a bed. Frequently this change is made to a youth bed which is somewhat smaller and lower than a full size single bed. Youth beds are commonly provided with side rails which are screwed or otherwise semi-permanently secured to the bed frame and therefore are not capable of being used with other beds or convenient to move from place to place.

The principal object of this invention is to provide a bed rail which can be used with virtually any bed and can be conveniently assembled for use and disassembled for storage or transport.

Another object of this invention is to provide a bed rail which can broken down into a compact unit so that it can easily be carried from place to place.

Still another object of this invention is to provide a light weight collapsible bed rail which is free of any screws, bolts or other fasteners that can be separated from the bed rail structure and be lost or misplaced.

To accomplish these and other objects, the bed rail of this invention includes among its features a side panel that is made up of two separate sections that snap together in coplanar relationship to form a unitary structure. The two panel sections can be separated easily and placed in face to face relationship for storage or transport. A pair of supports are releasably attached to the bottom of the side panel and are designed to slide beneath the mattress of a bed to hold the side panel erect in the operative position with respect to the bed. Each support when detached from the side panel can be collapsed to form a compact unit, and a storage compartment is provided in the bottom of each panel section to receive one of the supports. Consequently the supports when stored add no bulk to the collapsed bed rail, and therefore the bed rail can be conveniently stored in a carrying bag when not in use.

These and other objects and features of the present invention will be better understood and appreciated from a reading of the following detailed description of the preferred embodiment thereof shown in the accompanying drawings.

BRIEF DESCRIPTION OF THE DRAWINGS

FIG. 3 is a cross-sectional view of the bed rail of this invention taken along the section line 3—3 in FIG. 2 and shown in operative position on a bed;

FIG. 4 is a fragmentary cross-sectional view of the bed rail of this invention taken along the section line 4—4 in FIG. 3;

FIG. 5 is a fragmentary cross-sectional view of the bed rail taken along section line 5—5 in FIG. 4;

DETAILED DESCRIPTION OF THE INVENTION

Figure 1:
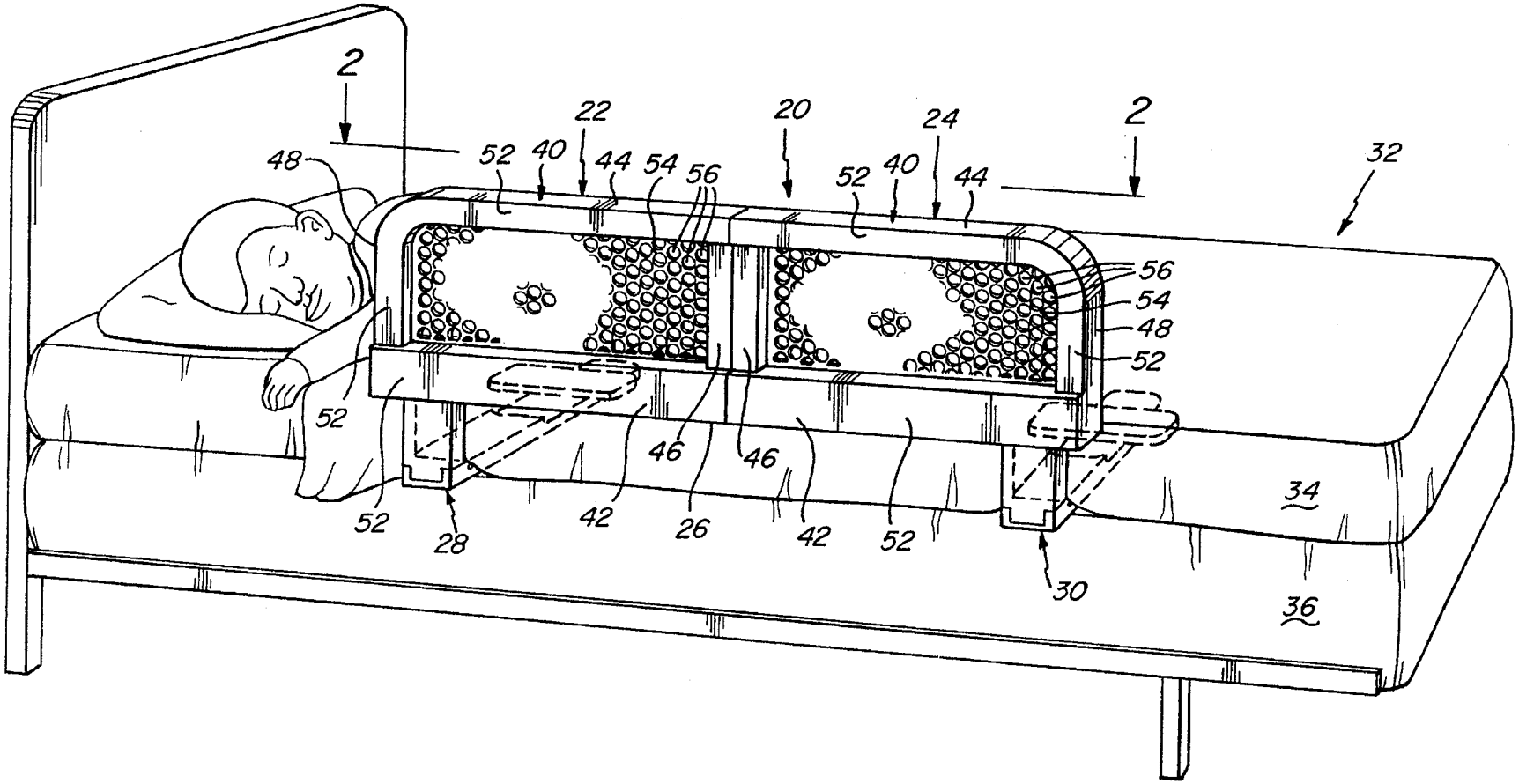
FIG. 1 is a perspective view of the collapsible bed rail of the present invention shown in use mounted on a bed having a box spring and mattress and occupied by a child.
Figure 2:
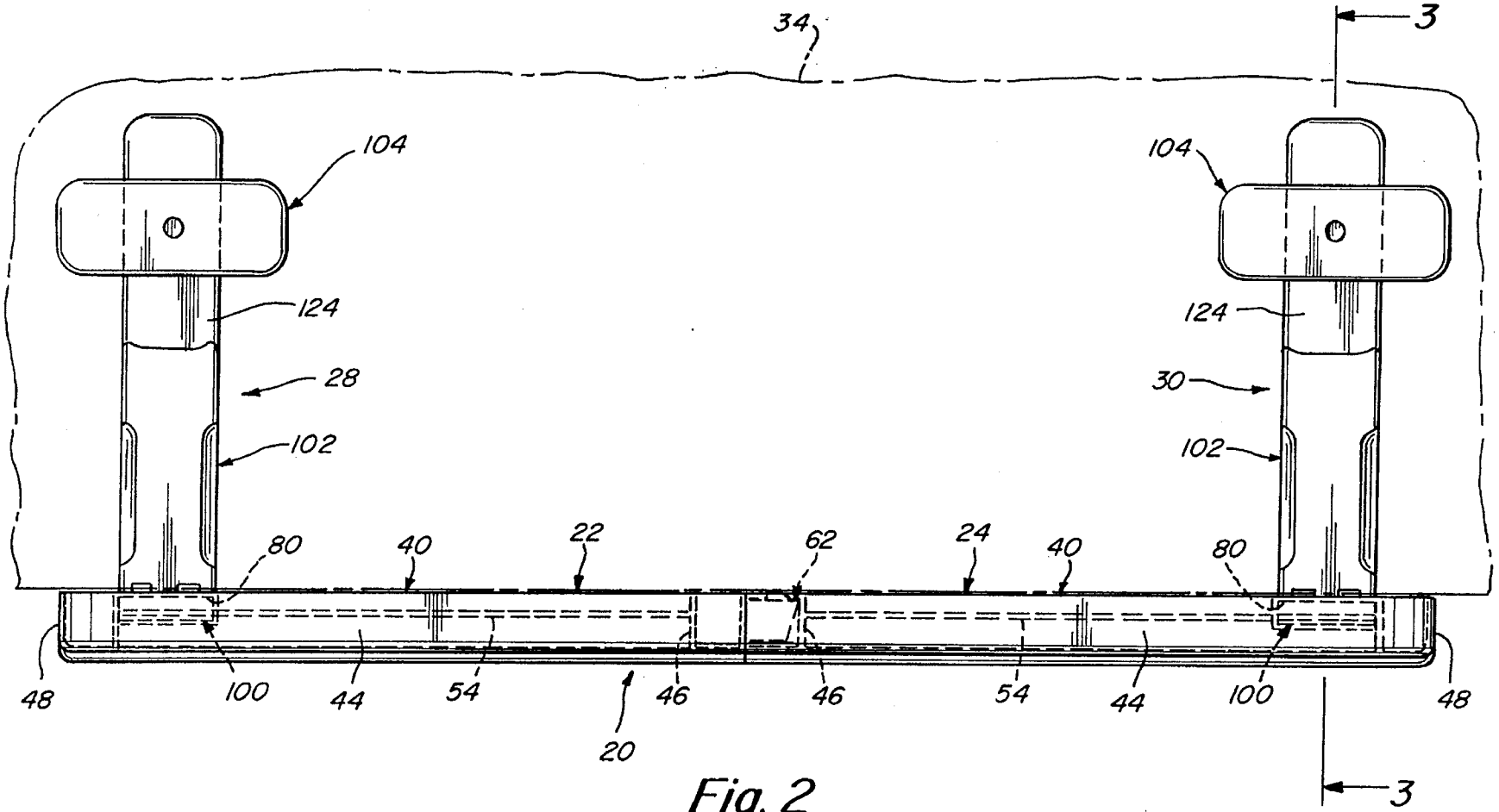
FIG. 2 is a top plan view of the bed rail of the present invention, viewed along sight line 2—2 in FIG. 1.
Figure 6:
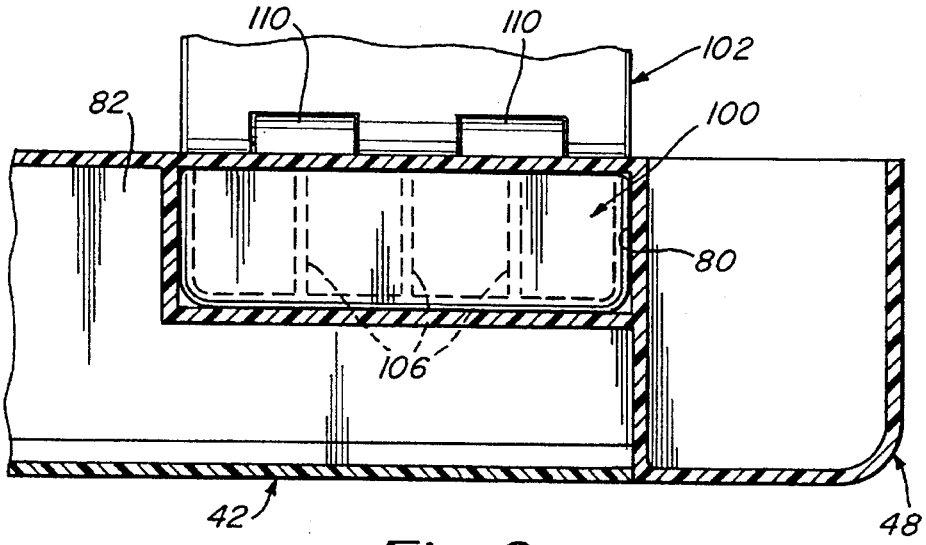
FIGS. 6 and 7 are fragmentary cross-sectional views taken along the corresponding section lines 6—6 and 7—7 in FIG. 3.

The collapsible bed rail shown in the drawing comprises a side panel 20 made up of two very similar sections 22 and 24 intended to be mounted along the side edge of a bed mattress with its lower edge 26 at the approximate height of the sleeping surface of the mattress. The side panel 20 is carried in that position by a pair of supports 28 and 30 which are detachably connected to the panel sections and which are positioned between the mattress and box spring. The side panel 20 and supports 28 and 30 are shown in FIG. 1 assembled together and mounted on the bed 32 between its mattress 34 and box spring 36. The details of the various parts of the bed rail are described separately below. The bed may be a youth bed, or a single, double, queen or king size and the bed rail operates in the same fashion for each.

Figure 10:
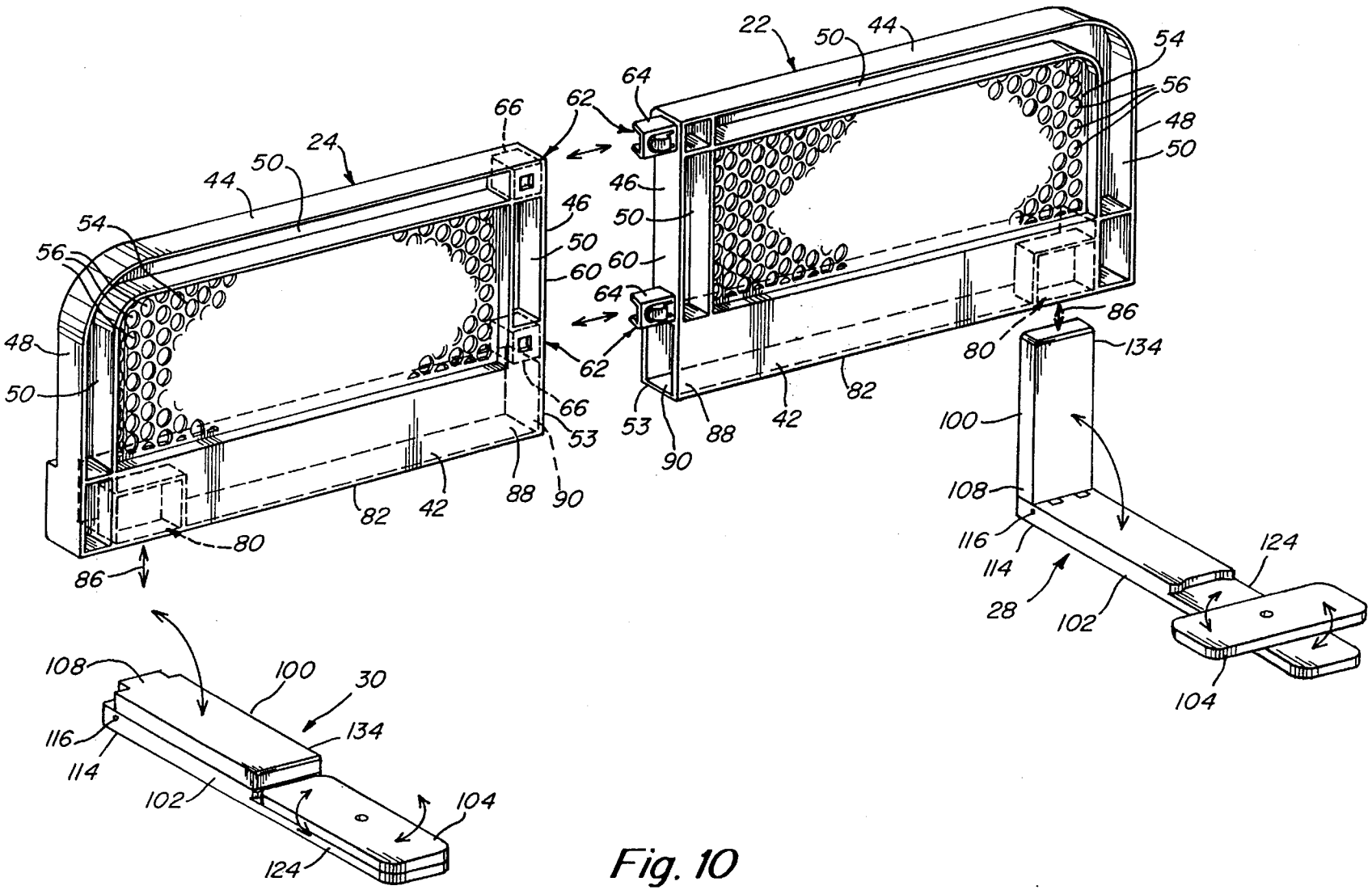
FIG. 10 is an exploded perspective view of the bed rail of the present invention and showing one of the bed rail supports in the operative position and the other in the collapsed position.
Figure 11:
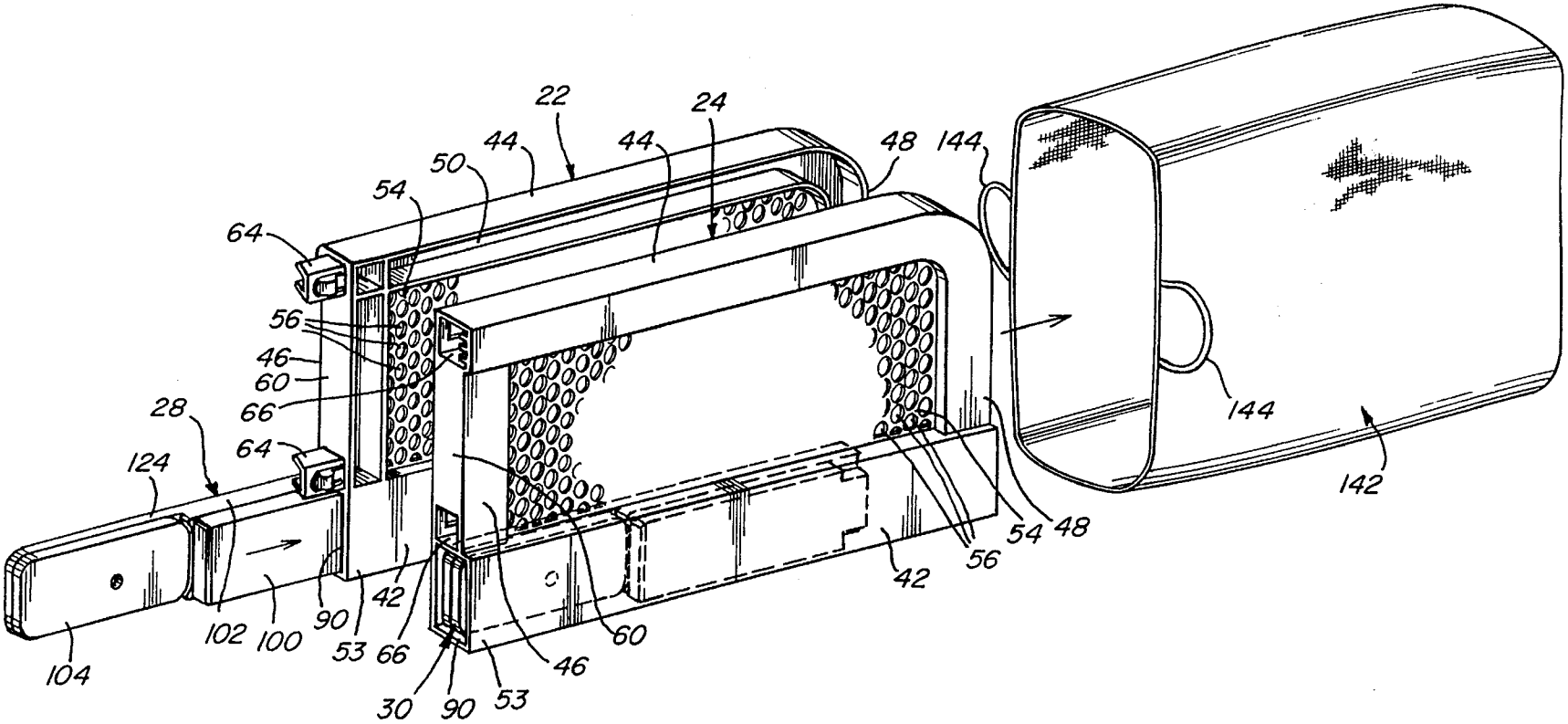
FIG. 11 is a perspective view of the bed rail of the present invention showing the manner in which the supports are stored within the frames of the panel sections and further showing the way the collapsed bed rail may be packaged in a carrying bag for travel or storage.

The panel sections 22 and 24 are clearly shown in FIGS. 1, 10 and 11. Each section has a frame 40 that includes a bottom rail 42, top rail 44, inside side rail 46 and outside side rail 48. The frame 40 is molded of a rigid plastic material such as polypropylene. The top, inside and outside side rails 44, 46 and 48 are generally U-shaped in cross-section, each open on the rear face 50 as shown in FIG. 10 (the side of the panel facing the bed 32 on which the unit is used) while the front face 52 of each of the rails of the frame is closed as is evident in FIGS. 1 and 11. The bottom rail 42 is enclosed on all four sides and defines a rectangular tube 53 which serves as a storage cavity when the bed rail is collapsed, as described in detail below. The frame 40 of each of the two panel sections 22 and 24 surrounds a rigid plastic screen 54 that has a dense array of circular openings 56 which allow free circulation of air through the panel sections 22 and 24 when mounted on a bed.

The panel sections 22 and 24 are essentially mirror images of one another and are designed to be assembled together as a unit as shown in FIGS. 1 and 10. For that purpose mating connectors 62 are provided on the outer faces 60 of the inside side rails 46 of the two panel sections. The connectors 62 on the panel section 22 are small rectangular sleeves 64 that extend from the outer face 60 of the inside side rail 46 and are received in receptacles 66 on the inside side rail 46 of the panel section 24.

As shown in FIGS. 4 and 5, the sleeves 64 each have a button 68 carried on a flexible and deflectable finger 70. The outer surface of each button 68 has a ramp 69 which enables the button to enter the corresponding receptacle 66 by deflecting the finger 70, and the button 68 when aligned with the opening 72 in the side wall 74 of the receptacle 66 snaps into place to lock the two parts of the mating connectors 62 together. The connectors 62 hold the panel sections 22 and 24 in coplanar relationship so that they together form a unitary side panel for the bed with which the unit is used. However, the two panel sections 22 and 24 can easily be separated merely by depressing the buttons 68 which are exposed through the openings 72 on the inner face 50 of the inside side rails 46. When the buttons 68 are depressed in that fashion and freed from the openings 72, the two panel sections can be pulled apart so that they can be placed in face to face relationship for storage and transport as is described more fully below. (The expression face to face includes front to front, back to back, and back to front.)

In FIG. 10 the bottom rails 42 of the frames are shown to have sockets 80 adjacent the outside side rails 48. The sockets 80 receive the supports 28 and 30 when the bed rail is assembled for use. The sockets 80 are open in the bottom wall 82 of the bottom rail 42 so that the supports can be inserted into them from the bottom as suggested by the arrows 86 in FIG. 10. The opposite end 88 of each bottom rail 42 at the inside side rail 46 is open as shown at 90 to provide access to the storage cavity in the bottom rail 42 where the supports 28 and 30 are stored when the bed rail is collapsed.

Figure 7:
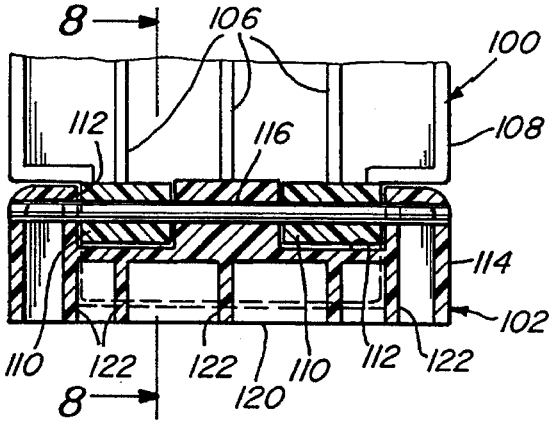
Figure 8:
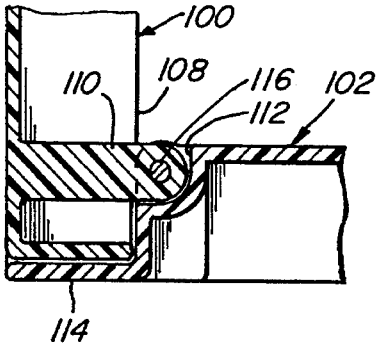
FIG. 8 is a fragmentary cross-sectional view of one bed rail support taken along section line 8—8 in FIG. 7.

The supports 28 and 30 are identical to one another. Support 30 is shown in the collapsed condition while support 28 is shown in the operative position in FIG. 10. Each support has an upper leg 100, lower leg 102 and foot 104. The upper leg 100 is molded of plastic material such as polypropylene and is generally U-shaped in cross-section with a few strengthening ribs running longitudinally along the trough of the member as suggested at 106 in FIG. 7. One end 108 of the upper leg 100 (the lower end when the support is in the operative position) is integrally molded with a pair of hinge barrels 110 that register with mating slots 112 in the adjacent end 114 of the lower leg 102, and a hinge pin 116 extends through the hinge barrels and the margins of the slots 112 to retain the ends 108 and 114 of the upper and lower legs 100 and 102 hinged together. As is evident in FIGS. 7, 8 and 10, the hinge connection that joins the two legs allows the upper leg to move between the operative position wherein it lies perpendicular to the lower leg 102 and an inoperative position wherein it lies flush against the surface 118 of the lower leg.

Figure 9:
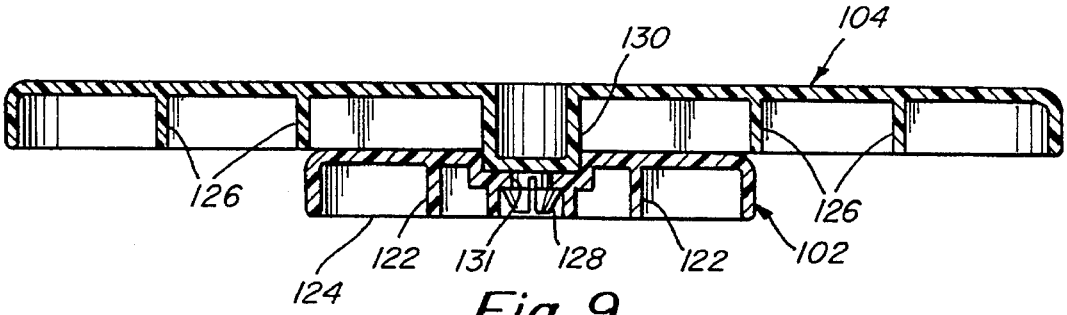
FIG. 9 is a fragmentary cross-sectional view of the bed rail support taken along section line 9—9 in FIG. 3.

The lower leg 102 like the upper leg is molded of plastic material such as polypropylene and has a U-shaped cross-section with the cross-section open along the bottom 120 when in the operative position. The lower leg 102 also has longitudinally extending ribs 122 within the cross-section, which strengthen and stiffen the structure. The thickness of the lower leg is reduced as shown at 124 at its end away from the hinge connection to the upper leg 100, to accommodate the foot 104. The foot like the two legs also is molded, has a U-shaped cross-section, and has longitudinally extending ribs 126 that strengthen and stiffen it. The foot is connected to the lower leg 102 on the portion 124 of reduced thickness by a snap fastener 128 on the bottom of a post 130, both molded as an integral part of the foot as best shown in FIG. 9. The fastener 128 extends through and is locked in an opening 131 in the center of the lower leg portion 124 and serves as a pivotal axis for the foot 104. The length of the foot 104 and the portion 124 of the lower leg are essentially the same so that the foot is free to rotate on the lower leg from the operative position assumed in support 28 and the inoperative or collapsed position assumed in support 30, both as shown in FIG. 10.

When the supports 28 and 30 are collapsed to the condition of support 30 in FIG. 10, they may be slipped into the storage cavities in the bottom rails 42 as suggested in FIG. 11, through the open ends 90. When the bed rail is to be used, the supports are erected by pivoting the legs 100 and 102 so that they are disposed perpendicular to one another and the feet 104 are turned to lie across the lower legs 102. The free ends 134 of the upper legs are inserted into the sockets 80 and are frictionally held in the sockets. The upper legs can be pulled out of the sockets when the side rail is to be disassembled.

From the foregoing description, the many advantages of this invention will be fully appreciated. The unit is easily collapsed for storage or travel by removing and thereafter collapsing the supports 28 and 30 and placing them in the cavities provided in the lower rails 42 of the panel sections 22 and 24. The two panel sections are readily separated by unfastening the mating connectors 62 on the inside side rails 46 of the panel sections and subsequently the two sections may be stored in face to face relationship. A convenient carrying bag 142 with handles 144 may be provided for storage and transport as shown in FIG. 11. The bed rail may be assembled and disassembled without the use of any tools. In use the several parts of the bed rail comprise a very sturdy assembly which will function as effectively as larger and/or heavier bed rails that are incapable of being stored or moved about without very considerable inconvenience.

From the foregoing description those skilled in the art will appreciate that numerous modifications may be made of the preferred embodiment shown in the drawings without departing from the spirit of this invention. Therefore, it is not intended that the scope of this invention be limited to the specific embodiment illustrated, but rather its scope is to be determined by the appended claims and their equivalents.

What is claimed is:

1. A collapsible bed rail comprising:

a pair of panel sections each having a rigid frame including top and bottom generally horizontal rails and inside and outside generally vertical side rails, mating connectors on the inside side rails of the panel sections for releasably connecting the sections in operative relationship wherein they are coplanar to form a continuous side panel, said connectors when separated enabling the two sections to be collapsed in face to face relationship with one another, a pair of supports for mounting the continuous side panel to a bed, each support having an upper leg, a lower leg and a foot, a hinge in each support pivotally connecting one end of the upper leg to one end of the lower leg enabling the upper leg in each support to move between an operative position wherein it is generally perpendicular to the lower leg and a collapsed position wherein it is lies parallel to and in face to face relationship with the lower leg, a connector joining the foot of each support to the other end of its respective lower leg, said connector enabling the foot to move between an operative position wherein the foot extends to the sides of the lower leg and a collapsed position wherein the foot is aligned with and in face to face relationship with its lower leg, a mounting socket in the bottom rail of each section for releasably receiving the other end of the upper leg of a support with said supports in operative position wherein the lower legs are horizontal when the continuous panel is vertical so as to be capable of being positioned beneath a mattress and support the panel in position, and storage cavities provided in the bottom rail of each section for receiving the supports when the top leg and foot of each is in the collapsed position.

2. A collapsible bed rail comprising:

a side panel having a frame with a lower portion, a pair of supports connected one adjacent each end of the lower portion of the frame for supporting the side panel in a vertical plane adjacent one side of a mattress when the supports are disposed beneath the mattress, and storage cavity in the frame for receiving the supports when they are detached from the frame.

3. A collapsible bed rail as defined in claim 2 wherein each of the supports includes upper and lower legs connected to and movable with respect to one another enabling them to be moved between an operative position wherein they are generally perpendicular to one another and a collapsed position wherein they lie in face to face relationship.

4. A collapsible bed rail as claimed in claim 3 wherein the side panel has two sections each having a frame, and mating connectors are carried on the frames for assembling the two sections in coplanar operative relationship and when released enabling the two sections to be collapsed in face to face relationship.

5. A collapsible bed rail as defined in claim 3 wherein each support has a foot, said foot extending outwardly from the lower leg in the operative position.

6. A collapsible bed rail as claimed in claim 2 wherein the side panel has two sections each having a frame, and mating connectors are carried on the frames for assembling the two sections in coplanar operative relationship and when released, enabling the two sections to be collapsed in face to face relationship.

7. A collapsible bed rail comprising:

a side panel having a frame, a pair of supports connected to the frame for supporting the side panel in a vertical plane when the supports are placed beneath a mattress, and a storage cavity in the frame for telescopically receiving the supports in an inoperative position.

8. A bed rail for preventing an occupant of a bed from falling from the bed comprising:

a side panel and at least one support connected to the panel for sliding under the mattress of the bed and carrying the panel in an operative generally vertical plane above the surface of the mattress, and a storage compartment in the panel for housing the support when the bed rail is not in use.

9. A collapsible bed rail as defined in claim 8 wherein the support is detachably connected to the panel for carrying the panel in its operative position.

10. A collapsible bed rail as defined in claim 9 wherein a socket is provided in the panel for receiving the support and detachably connecting the panel and support together.

* * * * *